United States Patent [19]

Tate

[11] 3,938,295

[45] Feb. 17, 1976

[54] METHOD FOR ASSEMBLING AN ACCESS FLOOR SYSTEM

[76] Inventor: Donald L. Tate, 46 St. Andrews Road, Severna Park, Md. 21146

[22] Filed: Feb. 27, 1975

[21] Appl. No.: 553,630

Related U.S. Application Data

[63] Continuation of Ser. No. 326,060, Jan. 23, 1973, abandoned.

[52] U.S. Cl. ..... 52/747; 29/468; 52/126; 52/127; 52/263; 52/DIG. 1

[51] Int. Cl.[2] ..... E04G 21/14

[58] Field of Search ..... 52/127, 126, 390, 273, 52/263, 747, 741, DIG. 1; 16/4, 6–8; 29/235, 467, 468; 15/215–217

[56] References Cited

UNITED STATES PATENTS

| | | | |
|---|---|---|---|
| 2,926,378 | 3/1960 | Exckhorn et al. | 76/4 |
| 3,012,919 | 12/1961 | Janney | 52/273 |
| 3,065,506 | 11/1962 | Tremer | 52/126 |
| 3,067,843 | 12/1962 | Rushtoh et al. | 52/126 |
| 3,324,614 | 6/1967 | Loewenan | 52/126 |
| 3,475,810 | 11/1969 | Mates | 52/127 X |
| 3,603,048 | 9/1971 | Hodfield | 16/4 X |
| 3,681,882 | 8/1972 | Bettinger | 52/126 |
| 3,696,461 | 10/1972 | Kelly | 16/16 |
| 3,696,472 | 10/1972 | Perina et al. | 52/127 X |
| 3,715,844 | 2/1973 | Breading | 52/273 |
| 3,772,841 | 11/1973 | Barak et al. | 52/741 |

FOREIGN PATENTS OR APPLICATIONS

| | | | |
|---|---|---|---|
| 1,914,705 | 10/1970 | Germany | 52/390 |

OTHER PUBLICATIONS

Sweet's Catalog copywright 12/70 1972 Vol. 11 TH45558 p. 13.9/wa.

*Primary Examiner*—Frank L. Abbott
*Assistant Examiner*—Leslie L. Braum
*Attorney, Agent, or Firm*—Oblon, Fisher, Spivak, McClelland & Maier

[57] ABSTRACT

Disclosed is an access floor system with deep pile carpet covered panels. The deep pile fibers from adjacent panels intermingle with each other to visually obscure the cracks between the panels. Disclosed is a tool and method for inserting or reinserting such panels into the floor system without pinching carpet pile between the panel edges. Disclosed is a floor system having service conduits running between adjacent panels but being visually undetectable due to the uniform appearance of the deep pile carpet covering.

4 Claims, 11 Drawing Figures

2
3
10
10
10
10
10
10
4
4
4
4
4
4
1

10
10
10
2
4
4
4
4
1

30
10
34
32
10
37
38
31
33
35
36
4
4

41
43
42
40
45
44

41
43
42
40A
46
44

10
13
14
2
E
11

METHOD FOR ASSEMBLING AN ACCESS FLOOR SYSTEM

This is a continuation of application Ser. No. 326,060 filed Jan. 23, 1973, now abandoned.

BACKGROUND OF THE INVENTION

This invention relates to access floor systems. Access floor systems are floor systems erected on a subfloor and have an elevated surface of floor panels supported above the subfloor by a system of supporting pedestals of a given height. The floor panels are generally of uniform size and are removable to allow access to the space between the subfloor and the elevated floor system. They have high integral strength and generally include a decorative, wear-resistant surface such as vinyl tile attached to the upper surface thereof. The panels are supported from below at their corners by pedestals of adjustable height and, in some installations, have additional supporting beams or stringers that run from pedestal to pedestal and lie under the edges of the panels.

Historically, the most common use for access floor systems has been in computer room installations. The space created between the subfloor and the access panel floor accommodates the large number of electrical connections necessary in computer installations and, in some installations, may further serve as an air plenum for air conditioning purposes. Other applications for access floor systems have existed, such as a "clean room" for use in research requiring a dust-free atmosphere. A clean room has a system to provide a vertical laminar flow of filtered air from filter banks in the ceiling to a plenum chamber formed by the access floor and subfloor. The air is generally recycled constantly from the ceiling filter banks through grates in the floor panels, and back again.

Designers and builders of commercial buildings have recently taken note of access floor systems and have realized that they may be employed in a number of applications in addition to those previously discussed. Modern construction techniques for office buildings have advanced to the point where the floors of the buildings are completely supported by interior columns and thus complete flexibility is permitted in the placement of interior walls. Electrical and telephone service must be provided, however, and conduits for these wires are generally buried in the concrete floor. Consequently the placement of electrical and telephone outlets are governed by the location of the conduits buried in the concrete floor. Much greater flexibility in the placement of outlets is possible if an access floor is installed above a subfloor having no conduits buried therein because the wires may be run under the access floor to an infinite number of locations.

Certain characteristics of access floor systems have discouraged wide scale acceptance in commercial applications other than computer flooring and the like. Most notable among them is the appearance of an access floor system. Panels covered with a hard surface such as vinyl tile generally have a trim edge running around the perimeter of the panel, and an access floor assembled with such panels has a checkerboard appearance. Although this checkerboard appearance is acceptable in a number of applications, it is considered objectionable in certain instances.

If access floor systems are to gain acceptance in office building applications, it is necessary to provide systems having carpet covered panels. Covering an entire floor system with a single piece of carpet defeats the advantages of an access floor system, i.e. ease in removal of only a portion of the floor. accordingly, it is necessary to cover each panel with an individual piece of carpet.

Commercially available carpet may be classified according to several characteristics. One is the manner in which the carpet pile is attached to the carpet backing. Woven carpet has an interlocked system of pile and backing that results in a relatively strong physical bond between pile and backing, but woven carpet is made with relatively complex manufacturing techniques and thus accounts for a relatively small proportion of the carpet market. Tufted carpet is made by pushing carpet pile through one side of a separate backing fabric and then coating the surface of the backing that will ultimately face the floor with some binding means such as adhesive. Tufted carpet is easier to manufacture than woven carpet and consequently accounts for a much greater share of the market, but the physical bond between pile and backing is relatively weak when compared to the bond in woven carpet. Needle punch carpet is manufactured by forming a nonwoven flock of fibers and then binding the flock together with yarns punched through the flock with a needle. Many of the commercially available "indoor-outdoor" carpets are produced by the needle punch method. The pile on such a carpet may be very short or relatively deep, depending on the requirements for ultimate use of the carpet.

Another classifying characteristic is type of carpet pile. Looped pile is, as its name implies, a pile formed with a continuous yarn that repeatedly passes through the backing of the carpet. A single line of pile, when viewed in a cross-sectional side view of a piece of carpet, resembles a sinusoidal curve with a high amplitude but a compressed period of repetition. A looped pile in a tufted carpet is prone to ravelling because of the relatively weak bond between pile and backing. A single loop may be grasped and tugged with sufficient force to pull an entire row of carpet pile out of the backing. A looped pile in a woven carpet, on the other hand, is locked in place and would not ravel in this manner. A cut pile carpet has a pile wherein each yarn rising from the backing terminates in a cut end rather than doubling back down to the backing to form a loop pile. Cut pile carpet may be made from a loop pile carpet that has been "shaved" on its surface to remove the uppermost portions of the loops, or may be made by inserting pre-cut lengths of pile into a backing. A tufted carpet with cut pile will not ravel like a loop pile tufted carpet, but individual piles may be pulled out of the backing with relatively little effort.

The length of the pile may also vary. Plush carpets have a relatively deep pile while carpets having a tighter or denser surface have a relatively short pile.

Employing carpet as a floor panel covering is desirable from the standpoint of expanding the market for access floor systems.

Attempts have been made to cover only the top surface of floor panels with carpet. If the carpet has a relatively short pile, the carpet fibers from adjacent panels will not intermingle in the region of the joint between the panels. Consequently, the objectionable checkerboard pattern is still visible. Additionally, if this short pile carpet is of the loop pile, tufted variety, the carpet on the panels has a tendency to ravel and the cut loops along the edge of the panel where the carpet was cut to fit the panel are of varying lengths and stick up as "stray" pile yarns.

Running this short pile carpet over the edges of the panel obviates the stray pile and ravelling problems, but, of course, the checkerboard pattern is even more detectable in an installed floor system and a greater quantity of carpet per panel is required. One advantage with such a panel, however, is that the pedestals may be adjusted with a somewhat lesser degree of precision because the slight gap created between the panels where the carpet curves over the edges makes it more difficult to visually detect slight variations in panel height. It is also possible to cover only the top surface of the panel with a short pile carpet and attach a trim edge of some material such as vinyl. Again, the checkerboard pattern is quite noticeable.

Covering only the top surface of a panel with a carpet having a deep, cut pile would be desirable from the standpoint of obscuring the joints between the panels. The pile fibers from adjacent panels blend and intermingle along the panel edges and visually obscure the joint. Additionally, the cut pile is of uniform height so no stray yarns are visible and the cut pile will not ravel. It is noted, however, that the pedestal system must be adjusted with precision or else shadow lines are evident between two panels of unequal height.

A major impediment, however, to the use of deep pile carpet on floor panels is the tendency of pile fibers from an adjacent panel to be pinched in the joint between panels when one panel has been removed and is then reinserted into place. Pile fiber pinching occurs because the pile from adjoining panels extends out past the edges of the adjoining panels and thus fibers are caught or pushed down into the joint between the panels when one panel is lowered into place. This pinched or distorted pile creates unsightly lines and bunching between the panels. This pinching problem exists with any carpet having a deep pile that tends to extend past the edge of the panel, regardless whether it is looped or cut pile, and regardless whether it is woven, tufted or needle punch carpet. The governing characteristic of the pile is its height.

Building code requirements vary from jurisdiction to jurisdiction, but most codes require that wires running underneath an access floor system must be metal shielded if the space is also being used as a plenum chamber. It has been proposed to provide metal conduits of square or rectangular cross section to run between adjacent panel rows and be supported in the level of the elevated floor. The upper surface of the conduit would then form a portion of the access floor surface. Wires shielded or insulated with a non-metallic shield could then be run in the conduit. Alternatively, the conduits could be used as air ducts or conduits for other services.

The appearance of such floor system with such conduits has been considered objectionable, however, when the panels and conduit are covered with either tile or carpet of the type that shows the joints between the elements of the floor system. Long thin strips are visible in the top surface of the floor where the conduit extends across the surface. The use of a deep pile carpet on access floor systems having such a conduit would solve this problem because the pile from adjacent panels and conduits will blend together and visually obscure the joints.

SUMMARY OF THE INVENTION

Disclosed is an access floor system employing panels covered with a deep pile carpet, thus enabling the joints between panels to be obscured to produce a uniform appearance and further to permit the addition of service carrying conduits within the plane of the elevated floor system in a manner that cannot be visually detected.

Also disclosed is a method for facilitating the insertion of deep pile covered floor panels into an access floor system without causing distortion or pinching of the carpet pile along the edges of adjoining panels, and an apparatus for use in such a method.

As previously described, deep pile carpet has not heretofore been employed with access floor systems because either during initial installation of a floor system or after a floor panel has been removed from the floor system, the insertion or reinsertion of the panel into place has been impossible wihout catching the pile fibers on the edges of adjoining panels and pinching the individual fibers down into the cracks between the panels. The term deep pile carpet as used herein is meant to include any type of carpet with a pile that would interfere with the insertion or reinsertion of panels into the floor system in a manner just described.

I have invented a tool for facilitating the insertion or reinsertion of a deep pile carpeted panel into place without pinching pile from adjoining panels. The tool includes a body having pile restraining means thereon and is adapted to be positioned along the edge of all of the floor panels that abut the panel to be installed. For example, four tools are used to restrain the pile on the four panels that abut a typical square panel located in the central portion of the system. The restraining means may be a flange that compresses and restrains the pile by holding it away from the edge of the adjacent panels to a degree sufficient to enable the missing panel to be reinserted without catching any of the pile fabric in the joint between the panels.

The tool consists of a body of a flat sheet of metal or the like and is dimensioned such that its length is equivalent to the width of the panel upon which it is to be used. The tool has the above-mentioned restraining means along one of its edges and has means thereon to enable the workman to engage the tool with the carpet on the panel such that the tool remains in place after the workman releases his hold on the tool. This may be accomplished by making the tool of a material with sufficient weight to hold the tool in place, or by providing some gripping means such as teeth or a rough frictional engaging means on the undersurface of the tool to grip the carpet pile on the panel. An example of such a frictionally engaging means is a strip of fabric having small hooks, such as a strip of Velcro.

By use of this tool, an access panel may be inserted or reinserted into the floor system and, after the carpet along the edge is fluffed or brushed, the joint between the panels will not be visually detectable.

This feature enables access floor systems to be used in applications requiring a floor uniformly covered with a plush, deep pile carpet, yet affords the flexibility provided by an access floor system with removable panels. Additionally, it is possible to employ service conduits such as air ducts or wire-carrying conduits between rows of panels in a manner that the top surface of the conduit, when covered with carpet, may blend into the floor without being visually detectable. Further, panels of a shape other than square may be employed without having the shape of the panel being visible. This feature may be useful with a panel in the shape of a triangle. Three points determine a plane, and a panel with three corners may be supported in a stable condition more easily than a panel with more than three corners.

Many millions of square feet of hard surface access floor panel systems are currently in use but heretofore it has been impossible to cover each panel with a piece of deep pile carpet because of the problems discussed above. By employing my invention, it is possible to apply deep pile carpet to the panels in these existing installations simply by attaching the carpet to the hard surface of the panel with adhesive, yet it is still possible to insert and reinsert the panels in place without pinching the carpet pile.

It is an object of the present invention to provide an access floor system with a covering of deep pile carpet that enables the system to present a uniform appearance, while providing a method and apparatus to facilitate the insertion of a panel into the system without pinching the pile fibers in the joint between the panels.

It is another object to provide an access floor system with a covering of deep pile carpet that may obscure the joints between adjacent panels or panels and other elements such as service conduits.

DESCRIPTION OF A PREFERRED EMBODIMENT

Figure 1:
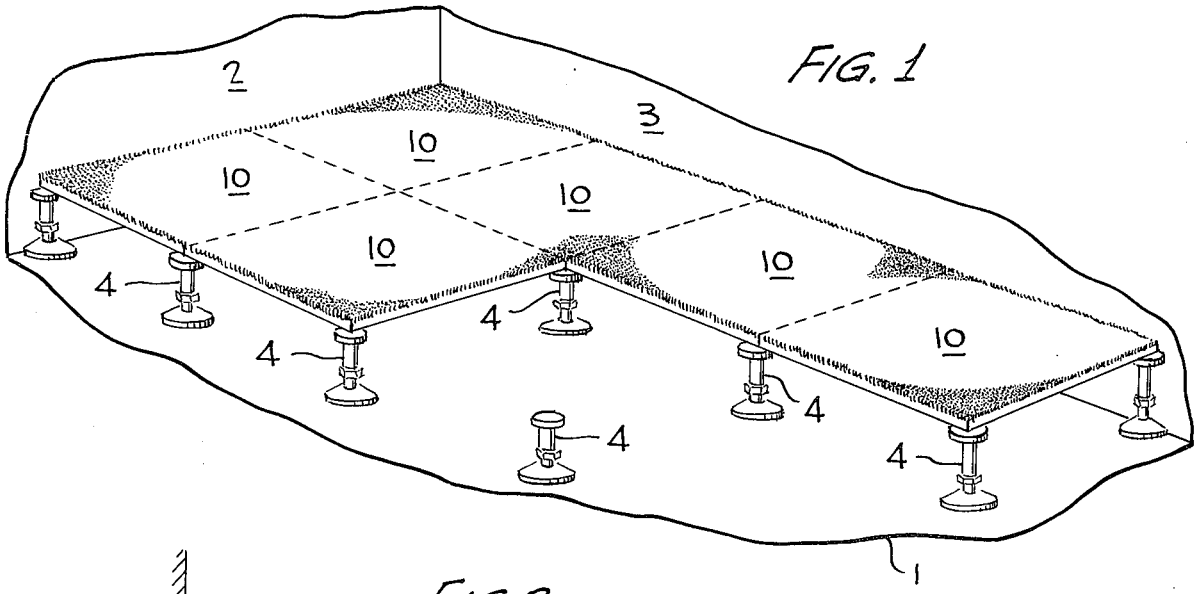
FIG. 1 is a perspective view of the floor system of my invention showing a number of deep pile carpet-covered panels positioned on pedestals, and showing an additional pedestal in place to receive an additional panel.

Referring to the drawing, FIG. 1 is a perspective view of my floor system showing the corner of a room having subfloor 1 and walls 2 and 3, and having pedestals 4 positioned on subfloor 1 in a predetermined pattern to receive deep pile carpet-covered panels 10. It is to be noted that the joints between the panels are indicated only by dotted lines because the deep pile of the carpet covering one panel intermixes and blends with the carpet pile on adjacent panels in a manner that visually obscures the edges of the panel.

Figure 2:
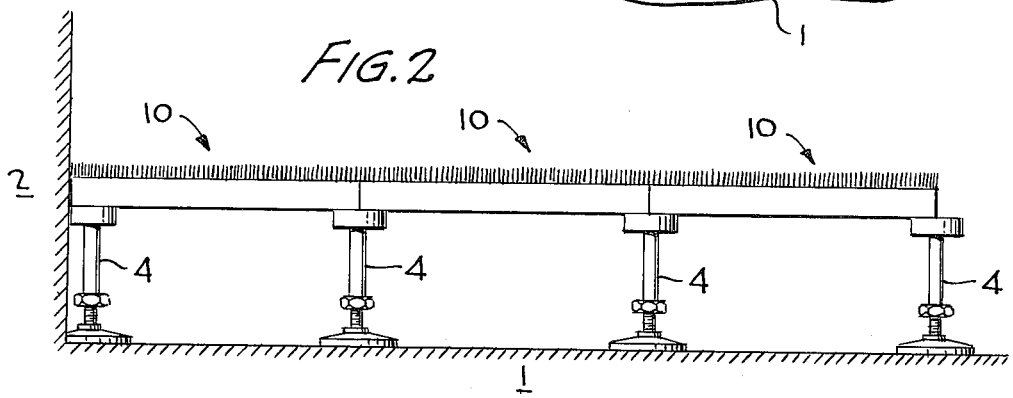
FIG. 2 is a side view of the access floor panels as they are supported by pedestals, and illustrating the uniform blending of the pile of the carpet along the edges of the panels.

Wih reference to FIG. 2, a plurality of panels 10 are seen to be supported above subfloor 1 by means of pedestals 4 in a manner that the edges of adjoining panels are in contact with each other. The fibers of the deep pile carpet along the edges of the panel blend and intermingle with the fibers on adjacent panels to provide a carpet covering that is uniform in appearance.

Figure 3:
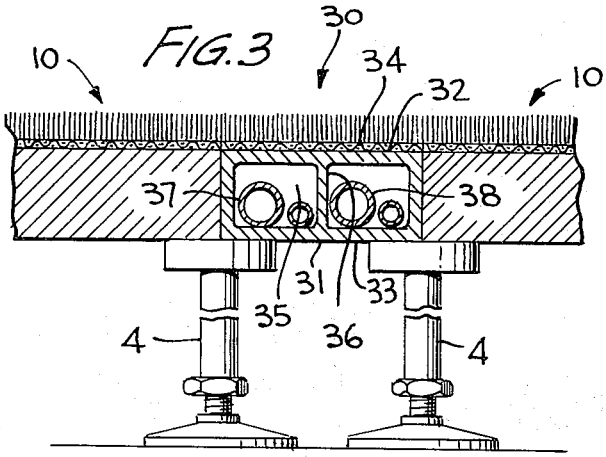
FIG. 3 is a side view in cross section of a modified floor system that includes a wire carrying conduit positioned between adjacent floor panels.

Uniformity of appearance is particularly desirable in a floor system having a separate service carrying conduit supported on the top of the floor system pedestals. The conduit is dimensioned such that its upper surface, when covered with a deep pile carpet, will be at the same level as adjacent floor panels. With particular reference to FIG. 3, the wire conduit indicated generally at 30 may consist of a metal conduit 31 that is square or rectangular in cross section and it has an upper surface 32 and a lower surface 33. The conduit is supported in the plane of the system and a piece of deep pile carpet 34 is attached to upper surface 32. Conduit 31 has a hollow interior 35 that may be divided into two separate compartments by partition 36. In this manner electrical wires 37 may be physically separated from telephone wires 38. The deep pile carpet 34 attached to the upper surface of conduit 31 has a pile that blends with the pile on the carpet covering adjacent panels 10 so that the joints between the conduit and its adjacent panels are visually obscured.

Figure 4:
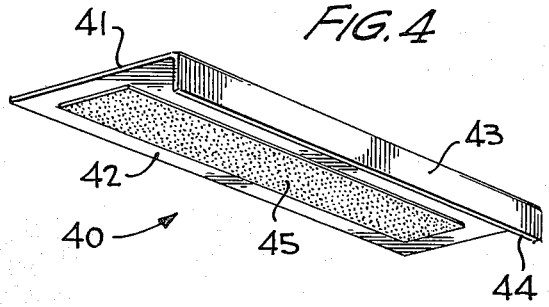
FIG. 4 is a perspective view as seen from below of an embodiment of the tool used to facilitate the insertion of a panel.
Figure 5:
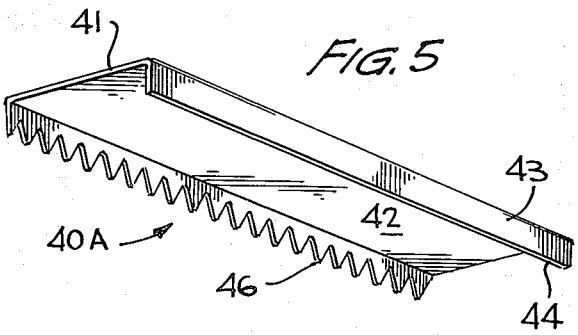
FIG. 5 is a perspective view as seen from below of another embodiment of the tool used to facilitate insertion of a panel.

The tool employed in the method of insertion of deep pile carpet-covered panels into an access floor system may be easily understood by reference to FIG. 4. Tool 40 includes a body portion 41 of sheet metal or the like with an upper surface (not visible in FIG. 4) and a lower surface 42. Along one edge of tool 40 is a pile restraining flange 43 which is disposed substantially at a right angle to portion 41 of the tool. Flange 43 terminates in an edge 44 which engages and compresses the carpet pile in a manner to be described below. Means are provided on the tool to retain it in position after the workman has placed the tool and released his grip. For example, the tool could be made of a material with sufficient weight so that gravity would hold the tool in place or, alternatively, the retaining means may frictionally engage the pile of the carpet. Tool 40, illustrated in FIG. 4, has a strip of Vercro 45 attached to its undersurface. Alternatively, a strip of sandpaper may be used. Tool 40A, illustrated in FIG. 5, has teeth 46 formed along the edge of the tool that is opposite flange 43. A handle or some other means to facilitate handling of the tool may be attached to the upper surface thereof and such a handle will preferably be of a form to permit the stacking of a plurality of tools one on top of another for ease in transporting the tool from job to job.

Figure 6:
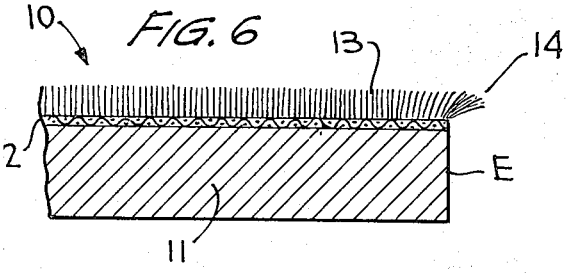
FIG. 6 is a cross sectional side view of the edge of a carpet covered panel illustrating the manner in which the carpet pile fluffs out beyond the edge of the access floor panel.

The manner in which tool 40 is employed to insert a deep pile carpet-covered panel into the access floor system is more easily understood with reference to FIGS. 6–10. FIG. 6 is a cross sectional side view of panel 10 showing rigid portion 11 of panel 10 covered with a deep pile carpet. The carpet backing 12 is glued to the upper surface of rigid portion 11 and deep pile 13 extends upwardly from backing 12. Portion 14 of the carpet pile fibers, by virtue of the piles natural fluffiness, extends past edge E of panel 10.

Figure 7:
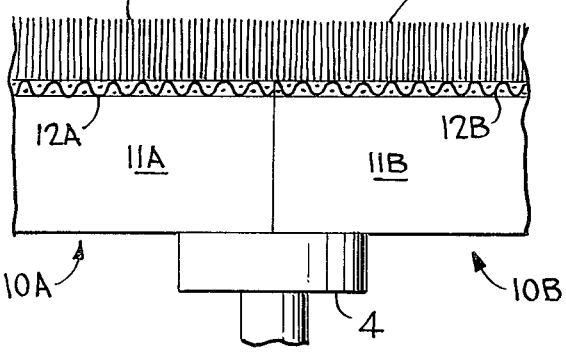
FIG. 7 is a cross sectional side view of two panels in position, showing the manner in which the deep pile of the carpet intermingles to obscure the crack therebetween.

FIG. 7 illustrates two deep pile carpet-covered panels as they are positioned in an installed access floor system. The adjacent edges of panels 10A and 10B are in contact with one another and the adjacent portions of pile 13A and 13B on the two respective panels intermingle and blend in a manner that will visually obscure the joint between the panels when the floor system is viewed from above.

Figure 8:
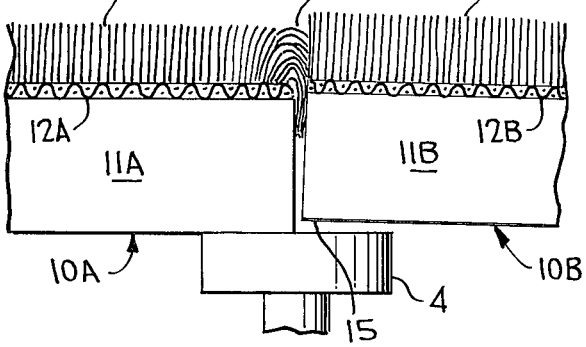
FIG. 8 is a cross sectional side view of two panels, the right panel having been inserted without employing my invention, and showing a portion of the pile from the left panel being caught or pushed down into the joint between the panels.

FIG. 8 illustrates the condition that will exist if panel 10B is installed or reinserted into the floor system without the use of tool 40. Portion 14 of pile 13A extends beyond edge E of panel 10 (FIG. 6) and, as panel 10B is lowered into place, lower edge 15 of panel 10B will pinch or catch pile 14 and draw it down into the space between the two adjacent panels. Pile 14 thus becomes jammed between the panels and creates an unsightly void or gap in the carpet pile at the point where the two panels abut one another.

Figure 9:
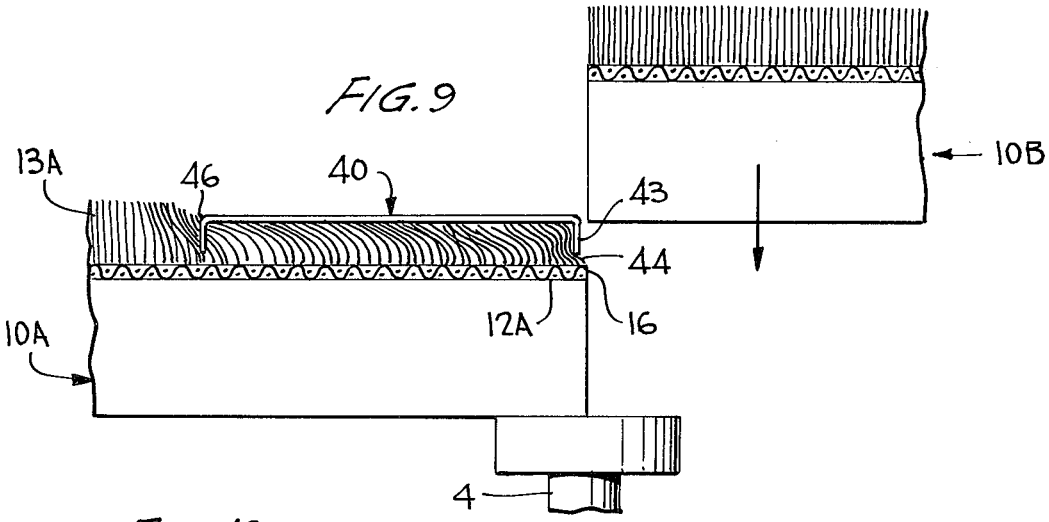
FIG. 9 is a side view of the manner in which a panel is inserted or reinserted into a floor system by employing my invention.

The use of tool 40 and the method of inserting the panel into place may best be understood with reference to FIG. 9. Panel 10A is shown positioned on pedestal 4 and panel 10B is shown in a position above the plane or level of the access floor system. Prior to the lowering of panel 10B into a contact with pedestal 4, tool 40 is positioned on top of pile 13A with pile restraining flange 43 positioned along the entire extent of the panel edge. Terminal portion 44 of flange 43 is positioned so that it is even with or slightly to the left of (FIG. 9) edge 16 of carpet backing 12A so that all of pile 13A is trapped beneath tool 40 and held away from the edge of panel 10A. It is desirable to position tool 40 along the edge of panel 10A by first holding tool 40 in a manner that, with reference to FIG. 9, flange 43 will initially be displaced to the right of panel 10A, and then drawing tool 40 toward the left such that all of portion 14 of the pile will be trapped beneath tool 40 and held in place with flange 43. After tool 40 is positioned in this manner, the carpet pile fibers are held away from panel 10A and panel 10B may be lowered into position. The tool may be held in place by means such as teeth 46, shown in FIG. 9 or other means such as element 45 shown in FIG. 4.

Figure 10:
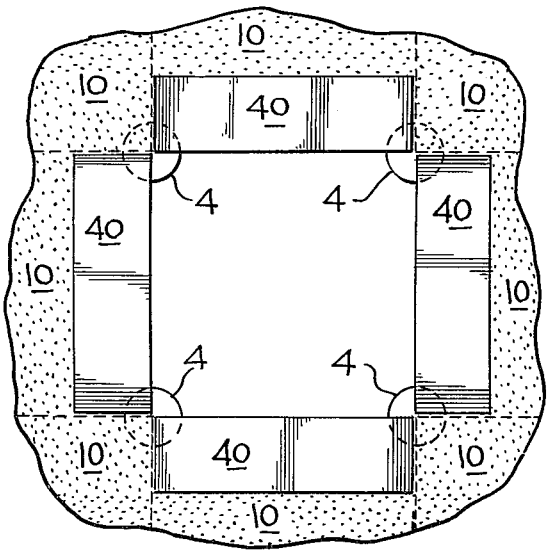
FIG. 10 is the top view of an access floor with the center panel removed and showing four of the pile restraining tools in position for the reinsertion of the missing panel.

FIG. 10 illustrates a top view of the access floor system with the center panel removed. The four adjacent panels thus have an edge adjacent the hole and, to facilitate reinsertion of the missing panel, a separate tool must be positioned along the edge of all four of these adjacent panels. Positioning the tools in the manner shown in FIG. 10 will restrain the pile from all four edges of the space created by the missing panel and thus the missing panel may be lowered into position without pinching or catching the carpet pile fibers from adjacent panels. If desired, a single composite tool having four appropriately positioned restraining flanges can be employed.

Figure 11:
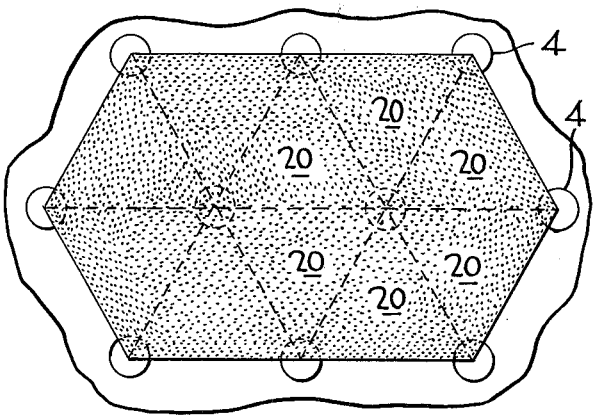
FIG. 11 is a top view of an access floor system using a panel with three corners rather than four corners.

Access floor systems employing the present invention may also be made from floor panels having a shape other than square or rectangular. For example, and with reference to FIG. 11, floor panels 20 may be equilateral triangles with three corners, each corner supported by a pedestal. Since three points define a plane, panels 20 may be supported in a stable configuration more easily than a four-cornered panel because pedestals 4 need not be adjested to as fine a degree of precision. Failure to adjust the pedestals in a four-cornered panel system results in a panel that will wobble or tilt. The deep pile carpet that covers panels 20 will visually obscure the joints between the panels, thereby obviating the heretofore expressed objections to the geometric pattern observable in an access floor system employing nonsquare panels having visible edges.

I claim:

1. A method of assembling a surface covering having a plurality of covering elements, each element having a face covered with pile fibers of a type that extend beyond the edges of said element unless restrained, comprising the steps of:

applying a pile restraining tool at the free ends of the pile at an edge of an installed element that is adjacent to the location wherein an additional element is to be installed, said pile fibers extending forwardly of said edge and into said location to a first position and said tool being applied to said fibers at said first position, manipulating said tool rearwardly in a direction away from said location and said first position to a second position slightly inwardly of said installed element edge so as to restrain said pile and prevent it from extending into said location, and inserting said additional element into said location such that said restrained pile is prevented from being pinched between adjacent elements during said assembling.

2. The method of claim 1 including the additional steps of removing said tool and fluffing said pile so that the fibers from adjacent elements merge to visually obscure the joints therebetween.

3. A method of assembling an access floor system with floor panels having the upper surface thereof covered with a deep pile carpet, the pile fibers of which are of the type that extend beyond the edges of said panels unless restrained, comprising the steps of:

applying a pile restraining tool at the free ends of the carpet pile at each edge of installed panels that is adjacent to the location wherein an additional panel is to be installed, said pile fibers extending forwardly of said edges and into said location to first positions and each of said tools being applied to said fibers at said first positions, manipulating all of said tools rearwardly in a direction away from said location and said first positions to second positions slightly inwardly of said installed panel edges so as to restrain said carpet pile and prevent it from extending into said location, and inserting said additional panel into said location such that said restrained pile is prevented from being pinched between adjacent panels during said assembling.

4. The method of claim 3 including the additional steps of removing said tools and fluffing said pile so that the fibers from adjacent carpeted panels merge to obscure the joint therebetween.

* * * * *